US009108443B2

(12) United States Patent
Kato

(10) Patent No.: US 9,108,443 B2
(45) Date of Patent: Aug. 18, 2015

(54) RECORDING APPARATUS AND TRANSPORTING APPARATUS

(71) Applicant: SEIKO EPSON CORPORATION, Tokyo (JP)

(72) Inventor: Junya Kato, Matsumoto (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 14/227,842

(22) Filed: Mar. 27, 2014

(65) Prior Publication Data

US 2014/0292883 A1 Oct. 2, 2014

(30) Foreign Application Priority Data

Mar. 29, 2013 (JP) ..... 2013-071610

(51) Int. Cl.

| | |
|---|---|
| ***B41J 29/38*** | (2006.01) |
| ***B41J 2/01*** | (2006.01) |
| ***B41J 11/00*** | (2006.01) |
| ***B41J 11/42*** | (2006.01) |
| ***B41J 15/04*** | (2006.01) |

(52) U.S. Cl.
CPC ..... *B41J 11/0075* (2013.01); *B41J 11/42* (2013.01); *B41J 15/04* (2013.01)

(58) Field of Classification Search
CPC .. B41J 11/0095; B41J 11/0065; B41J 13/103; B41J 29/393; B41J 29/38; B41J 11/003; B41J 11/46; B41J 13/0009; B41J 11/007; B41J 11/0075; B41J 15/04; B41J 11/42
USPC ..... 347/16, 104
See application file for complete search history.

(56) References Cited

FOREIGN PATENT DOCUMENTS

| | | | |
|---|---|---|---|
| JP | 2004-136514 A | | 5/2004 |
| JP | 2004136514 A | * | 5/2004 |
| JP | 2005-349744 A | | 12/2005 |
| JP | 2005349744 A | * | 12/2005 |
| JP | 2012-218308 A | | 11/2012 |

* cited by examiner

*Primary Examiner* — Jannelle M Lebron
(74) *Attorney, Agent, or Firm* — Maschoff Brennan

(57) ABSTRACT

A recording apparatus in which a recording unit performs recording with respect to a medium which is wound in a roll shape, the apparatus including a medium support unit which rotatably supports the medium; a transport unit which transports the medium in a path while pulling out the medium which is supported; and a terminal end detection unit which detects a terminal end of the medium. The transport unit transports the medium to an outlet side to which the medium, which is recorded, is discharged, when the terminal end is detected, and a length of the medium is equal to or larger than a predetermined value. On the other hand, the transport unit transports the medium to the medium support unit side, when the terminal end is detected, and the length of the medium is less than the predetermined value.

6 Claims, 7 Drawing Sheets

RECORDING APPARATUS AND TRANSPORTING APPARATUS

BACKGROUND

1. Technical Field

The present invention relates to a recording apparatus and a transporting apparatus which use a medium which is wound in a roll shape.

2. Related Art

In the related art, an apparatus using a medium which is wound in a roll shape is known. In such an apparatus, the medium which is supported by being wound in the roll shape is used by being transported so as to be pulled out. In addition, the transported medium is discharged to the outside of the apparatus.

In addition, when the medium is used up to the vicinity of a terminal end, it is necessary to change the medium to a new medium. For this reason, an apparatus is disclosed in which roll sheet is cut using a cutter which is arranged in the vicinity of a position at which the roll sheet is supported when a roll end (terminal end) of the roll sheet is detected. In addition, the apparatus determines whether to transport the roll sheet, or to make the roll sheet stay at a position after cutting, according to the length of the roll sheet after the cutting (for example, refer to JP-A-2012-218308).

When the medium stays in a path in a state of being cut, there is a case in which it is not possible to take the cut medium out due to a structure of the apparatus. For example, there is a case in which, when the path of the medium is located at a deep position in the apparatus, it is necessary to remove the medium which stays in the path from the path at the deep position, and a worker is forced to perform hard work.

SUMMARY

An advantage of some aspects of the invention is to provide a recording apparatus and a transporting apparatus in which an exchange of a medium can be performed without forcing a worker to perform hard work, when a medium which is supported by being wound in a roll shape is exchanged.

According to an aspect of the invention, there is provided a recording apparatus in which a recording unit performs recording with respect to a medium for recording which is wound in a roll shape, the apparatus including a medium support unit which rotatably supports the medium for recording; a transport unit which transports the medium for recording while pulling out the medium for recording which is supported; and a terminal end detection unit which detects a terminal end of the medium for recording, in which the transport unit transports the medium for recording to an outlet side to which the medium for recording, which is recorded upon, is discharged, when the terminal end is detected, and a length of the medium for recording is equal to or larger than a predetermined value, and transports the medium for recording to the medium support unit side, when the terminal end is detected, and the length of the medium for recording is less than the predetermined value.

In the invention which is configured in this manner, the transport unit transports the medium for recording which is rotatably supported by the medium support unit into a path while pulling out the medium. In addition, when the terminal end of the medium for recording which is transported is detected by the terminal end detection unit, the transport unit transports the medium for recording to the outlet side when the length of the medium for recording is equal to or larger than the predetermined value. On the other hand, when the terminal end of the medium for recording is detected, and the length of the medium for recording is less than the predetermined value, the transport unit transports the medium for recording to the medium support unit side.

For this reason, when exchanging the medium for recording which is used up to the terminal end, the medium for recording is discharged from the outlet when the length of remains of the medium for recording is long. On the other hand, when the remains of the medium for recording is short, it is possible to allow the medium for recording to be easily taken out by transporting the medium for recording to the medium support unit side. As a result, it is possible to reduce a work load when exchanging the medium for recording.

Here, the medium for recording may be any medium on which a recording medium such as ink can be recorded.

In addition, a recording unit may be any type of a unit which can perform recording with respect to a medium for recording, and is well known.

In the apparatus, a shielding unit may be located between the medium support unit and the transport unit on a path of the medium for recording, and the medium for recording may be transported to the transport unit while passing through an insertion opening which is formed in the shielding unit.

With such a configuration, it is possible to return the medium for recording to the medium support unit side through the insertion opening, and to reduce the work load when exchanging the medium for recording, even when the transport unit is shielded.

In the apparatus, a cutting unit which is located on a downstream side of the medium support unit on the path of the medium for recording, and cuts the medium for recording may be further included, and the cutting unit may cut the medium for recording when the terminal end is not detected, and may not cut the medium for recording when the terminal end is detected.

With such a configuration, when the terminal end of the medium for recording is detected, the medium for recording is transported in any one of directions without being cut. As a result, it is possible to reliably cut the medium for recording without causing the medium for recording to remain in the path.

The apparatus may further include a transport amount obtaining unit which obtains a transport amount of the medium for recording, and a length of the medium for recording may be determined based on a transport amount of the transport unit from discharging of a portion of the medium for recording on which the recording is performed to detecting of the terminal end.

With such a configuration, it is possible to determine the length of the medium for recording based on the transport amount of the transport unit.

In the apparatus, the medium support unit may further include a first medium support unit and a second medium support unit, and the transport unit may transport either a medium for recording which is supported by the first medium support unit, or a medium for recording which is supported by the second medium support unit.

With such a configuration, it is possible to execute a large amount of jobs at once, since it is possible to use a plurality of media to be recorded upon.

In the apparatus, when detecting the terminal end of the medium for recording which is supported by the first medium support unit, the transport unit may switch to transport of the medium for recording which is supported by the second medium support unit.

With such a configuration, even when a terminal end of a medium for recording on one side is detected, it is possible for a worker to continue recording without taking out the medium for recording, since a medium for recording on the other side is transported.

In the apparatus, the predetermined value may be set according to the length of a path on which the medium for recording which is supported by the medium support unit.

With such as configuration, since the predetermined value can be set according to the length of the path, it is possible to design an arrangement position of the medium support unit more flexibly.

In addition, the invention can be applied to a transporting apparatus which transports a medium for recording.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments of the invention will be described in the following order.

1. First Embodiment
2. Second Embodiment
3. Other embodiments

1. First Embodiment

Figure 1A:
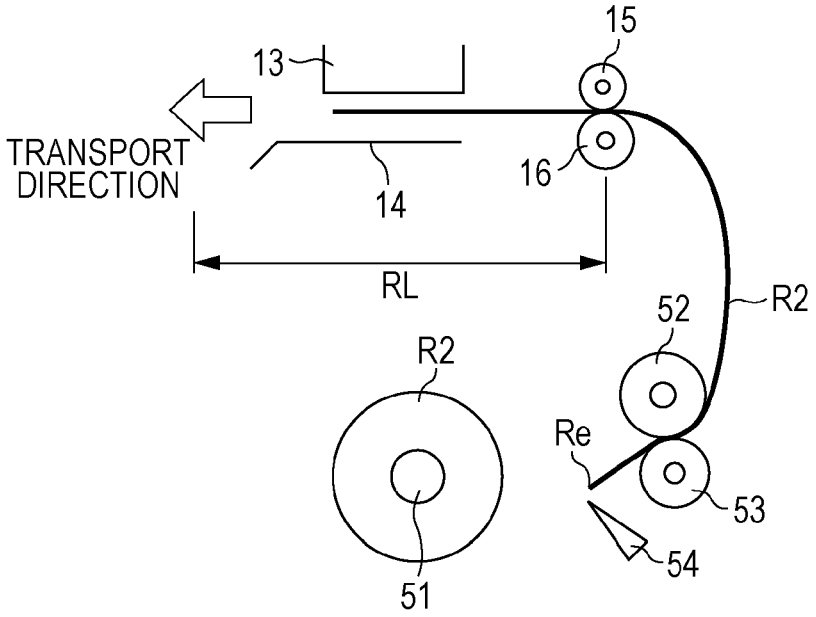
FIGS. 1A and 1B are side views which exemplify main portions of a recording apparatus in order to describe examples of the present technology.
Figure 1B:
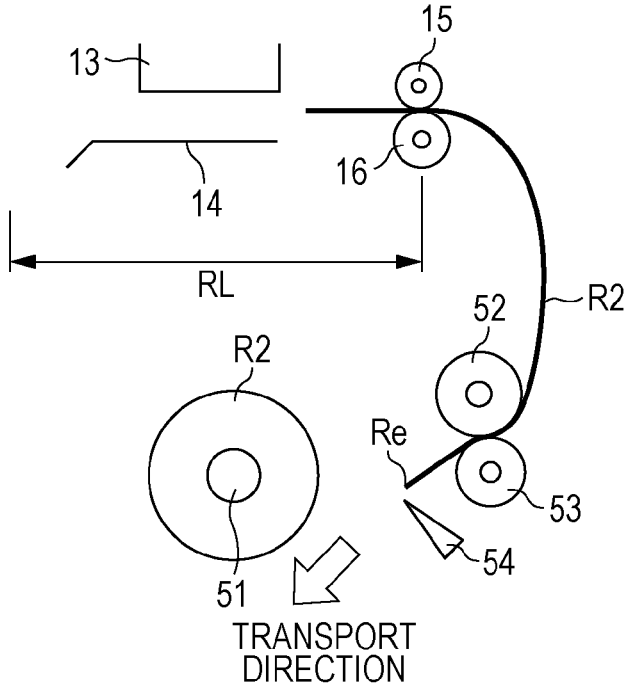
Figure 2:
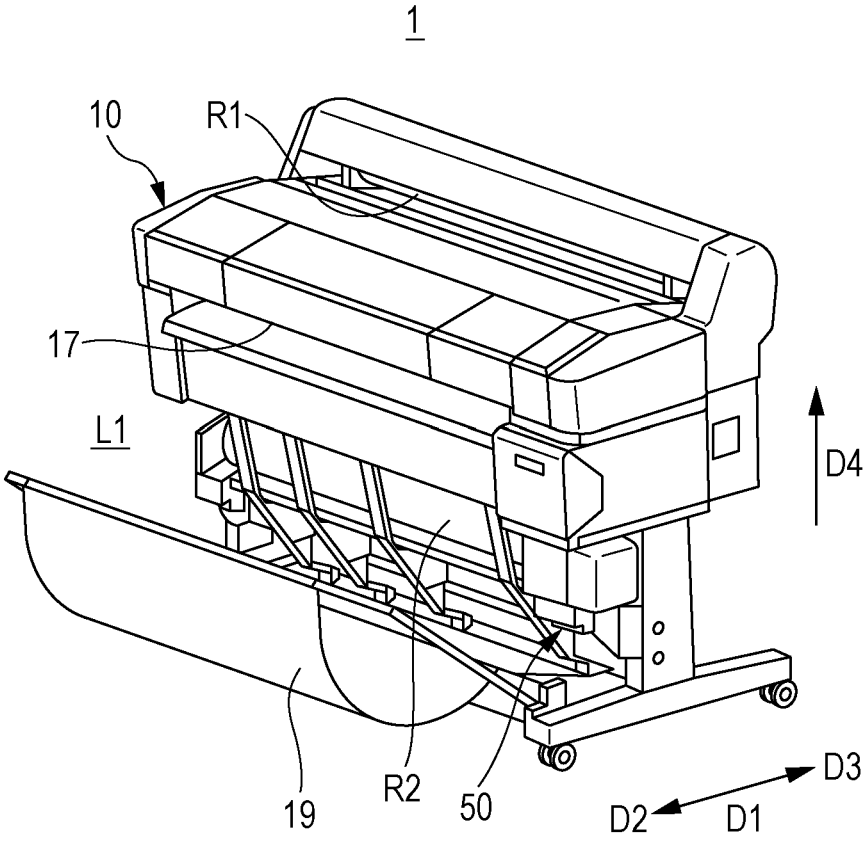
FIG. 2 is a perspective view which illustrates an appearance of a large ink jet printer as an example of a recording apparatus.
Figure 3:
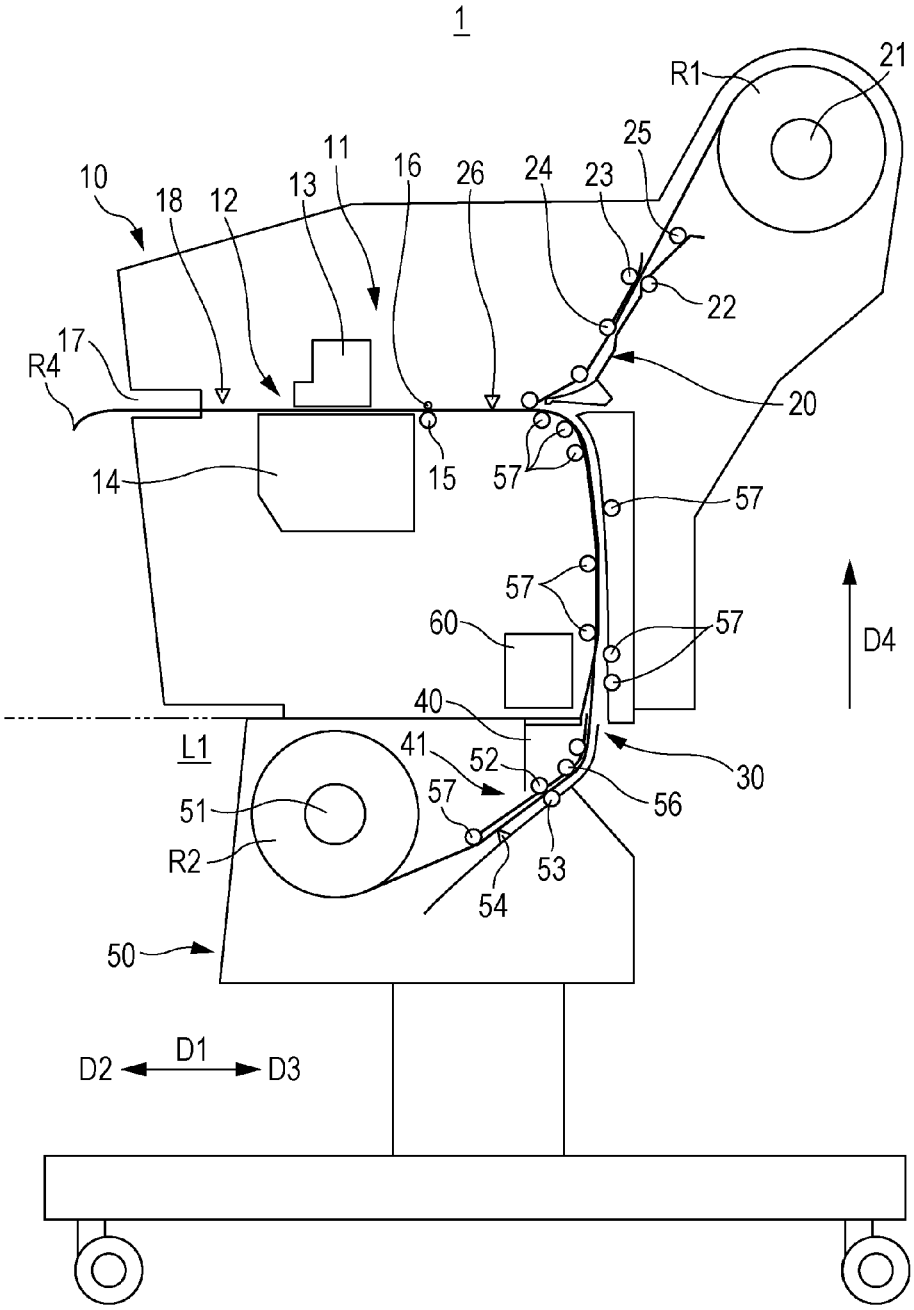
FIG. 3 is a vertical sectional view which illustrates the recording apparatus of which a stacker is omitted.
Figure 4:
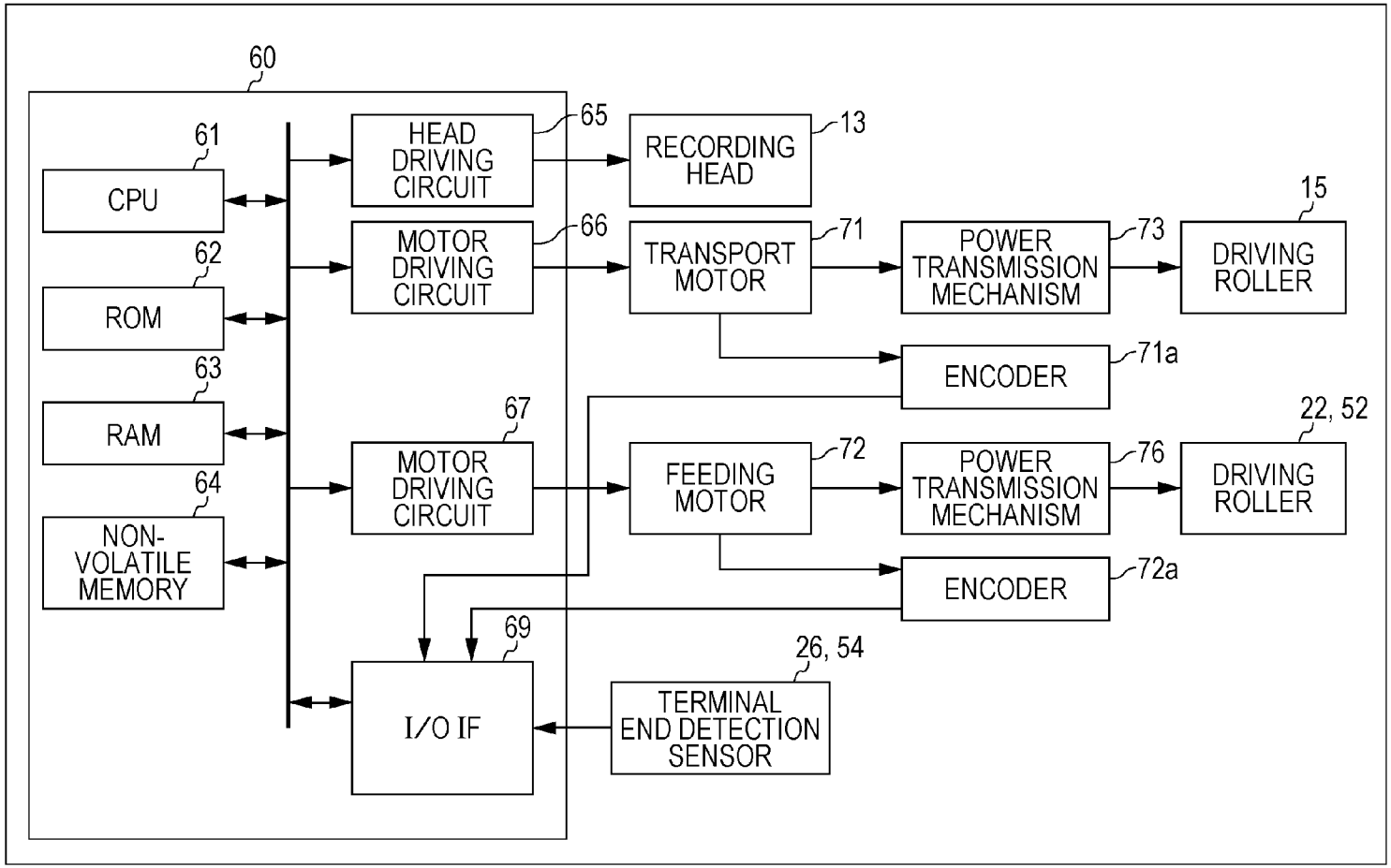
FIG. 4 is a block diagram which describes a configuration of the recording apparatus.

FIGS. 1A and 1B are side views which exemplify main portions of a recording apparatus in order to describe examples of the technology. In addition, FIG. 2 is a perspective view which illustrates an appearance of a large ink jet printer as an example of the recording apparatus. In addition, FIG. 3 is a vertical sectional view which illustrates the recording apparatus of which a stacker 19 is omitted. Further, FIG. 4 is a block diagram which describes a configuration of the recording apparatus.

According to the first embodiment, the recording apparatus is realized as an ink jet printer which performs recording with respect to roll sheets (medium for recording, medium to be transported) R1 and R2.

As illustrated in FIG. 2, a recording apparatus 1 includes a housing 10, and a feeding unit 50 which is provided in a slidable manner in the sliding direction D1 with respect to the housing 10. In addition, the recording apparatus 1 can perform printing (perform recording) by performing switching between the roll sheet R1 located at a deep position on the upper part of the apparatus and the roll sheet R2 located on the lower part of the apparatus. In addition, it is possible to discharge the roll sheets R1 and R2 from an outlet 17 (R4 illustrated in FIG. 3).

In the above described figure, a mark D1 denotes a sliding direction of the feeding unit 50 with respect to the housing 10. A mark D2 denotes a withdrawing direction which goes toward a withdrawing position from an accommodating position L1 of the feeding unit 50. A mark D3 denotes an accommodating direction which goes toward the accommodating position L1 from the withdrawing position of the feeding unit 50.

The roll sheet is a continuous sheet in which the sheet is wound in a roll shape. The outer sides of the roll sheets R1 and R2 are set to recording surfaces. As a matter of course, when changing positions of feeding mechanisms 21 and 51, it is also possible to use a roll sheet of which the inside is set to a recording surface. As the roll sheet, it is possible to use a wound sheet of various materials such as paper, cloth, a plastic sheet, or leather.

In addition, as illustrated in FIG. 3, or the like, the housing 10 includes a recording unit 12, a pair of transport rollers (transport unit) 15 and 16, a cutter (cutting unit) 18, paths 11, 20, and 30, feeding mechanisms (21 to 26), feeding mechanisms (51 to 57), and a control unit 60 therein.

A transport path 11, a first feeding path 20, and a second feeding path 30 are included in a path on which the roll sheet R1 or the roll sheet R2 is fed and transported. The transport path 11 is a path on which recording with respect to the roll sheet R1 (R2) is performed. In addition, the first feeding path 20 is a path on which the roll sheet R1 is fed with respect to the pair of transport rollers 15 and 16. In addition, the second feeding path 30 is a path on which the roll sheet R2 is fed with respect to the pair of transport rollers 15 and 16.

In addition, a definition of each path 11, 20, or 30, and a positional relationship thereof are not limited to this. For example, a part of the transport path 11 and a part of the first feeding path 20 or the second feeding path 30 may overlap. In addition, a different path may be formed between each of paths.

On the transport path 11, the pair of transport rollers 15 and 16, and the recording unit 12 are arranged.

The pair of transport rollers 15 and 16 includes a driving roller 15 which is arranged on the downstream side, and a driven roller 16 which is arranged on the upstream side. The driving roller 15 rotates due to a transport motor 71 which will be described later. In addition, the driven roller 16 is rotatably supported, and a medium for recording is interposed between the driving roller 15 and the driven roller 16. For this reason, the driven roller 16 rotates following the roll sheets R1 and R2 which are transported due to rotating of the driving roller 15.

The recording unit 12 is arranged on the downstream side of the pair of transport rollers 15 and 16 in the transport path 11. The recording unit 12 includes a recording head 13, and a platen 14 which supports the roll sheets R1 and R2 which are transported from below. According to the embodiment, the recording apparatus 1 is described as a serial printer which moves the recording unit 12 in a direction crossing a direction in which the roll sheets R1 and R2 are transported by a carriage which is not shown. However, the recording apparatus 1 may be a line head printer.

The first feeding path 20 is provided with a feeding mechanism (first medium support unit) 21 which supports the roll sheet R1, a pair of feeding rollers 22 and 23, kolo rollers 24 and 25, a terminal end detection sensor 26, and the like.

The feeding mechanism 21 rotatably supports the roll sheet R1 using a roll shaft. According to the embodiment, the feeding mechanism 21 does not have power for rotating the roll sheet R1, however, the feeding mechanism 21 may be a mechanism which has power for rotating the roll sheet R1.

The pair of feeding rollers 22 and 23 includes a driving roller 22 which is arranged on the lower side, and a driven roller 23 which is arranged on the upper side by interposing the roll sheet R1 which is fed on the first feeding path 20 therebetween. The driving roller 22 rotates due to a rotation of a feeding motor 72 which will be described later, and feeds the roll sheet R1. In addition, the driven roller 23 rotates by following the roll sheet R1 which is fed according to a rotation of the driving roller 22 while interposing the roll sheet R1 between the roller and the driving roller 22.

The kolo rollers 24 and 25 are rotatably supported on a wall of the first feeding path 20, and slightly protrude into the path from the inside of the wall.

The terminal end detection sensor 26 is arranged on the downstream side of the pair of feeding rollers 22 and 23 on the first feeding path 20. The terminal end detection sensor 26 detects a roll end (terminal end) of the roll sheet R2. In addition, a determination on whether or not the roll sheet R1 is being fed may be made by including a medium detection sensor (not shown) in the first feeding path 20.

In addition, a feeding mechanism (second medium support unit) 51 which supports the roll sheet R2 is arranged in the feeding unit 50. In addition, a shielding unit 40 which isolates the second feeding path 30 is formed between the feeding mechanism 51 and a pair of feeding rollers 52 and 53 which will be described later, of the feeding unit 50. For this reason, even when pulling out the feeding unit 50 at a pulling out position, the second feeding path 30 is shielded by the shielding unit 40, and cannot be viewed. In addition, an insertion opening 41 for inserting a tip end of the roll sheet R2 which is pulled out is formed in the shielding unit 40. The insertion opening 41 is a rectangular opening corresponding to the width of the roll sheet.

In addition, the pair of feeding rollers 52 and 53, a terminal end detection sensor 54, and kolo rollers 56 and 57 are located on the second feeding path 30.

The pair of feeding rollers 52 and 53 includes a driving roller 52 which is arranged on the upper side, and a driven roller 53 which is arranged on the lower side by interposing the roll sheet R2 which is fed on the second feeding path 30 therebetween. The driving roller 52 rotates according to a rotation of a feeding motor 72 which will be described later.

In addition, the driven roller 53 rotates by following the roll sheet R2 which is fed according to a rotation of the driving roller 52 while interposing the roll sheet R2 between the roller and the driving roller 52.

In addition, the driving roller and the driven roller which configure a pair of rollers may be arranged so as to be opposite to the above described positional relationship. In addition, the pair of rollers may be configured of a pair of driving rollers using a driving roller instead of a driven roller.

The terminal end detection sensor 54 is arranged on the upstream side of the pair of feeding rollers 52 and 53 on the second feeding path 30. The terminal end detection sensor 54 detects a roll end of the roll sheet R2. The terminal end detection sensors 26 and 54 which are located on the first and second feeding paths 20 and 30 are configured using a well-known sensor such as an optical sensor, for example. In addition, whether or not the roll sheet R2 is being fed may be determined by providing a medium detection sensor (not shown) on the second feeding path 30.

The kolo rollers 56 and 57 are arranged on the downstream side of the pair of feeding rollers 52 and 53 on the second feeding path 30. The kolo rollers 56 and 57 are rotatably supported on a wall of the second feeding path 30, and slightly protrude into the path from the inside of the wall.

As illustrated in FIG. 4, the control unit 60 includes a Central Processing Unit (CPU) 61, a Read Only memory (ROM) 62, a Random Access Memory (RAM) 63, a non-volatile memory 64, a head driving circuit 65, motor driving circuits 66, 67, and 68, and an I/OIF 69. In the ROM 62, a control program or data which is executed by the CPU 61 is recorded. The CPU 61 integrally controls driving of the recording apparatus 1 by executing the control program or data which is recorded in the ROM 62 while manipulating data thereof in the RAM 63.

In addition, job data which is used in a recording process is recorded in the non-volatile memory 64. For example, when receiving job data from an external device such as a personal computer (not shown), the control unit 60 temporarily stores the job data in the non-volatile memory 64.

The head driving circuit 65 is electrically connected to the recording head 13, and drives the recording head 13 using a command from the CPU 61. The recording head 13 is, for example, an ink jet recording head which ejects ink from nozzles. The recording head 13 ejects ink from the nozzles, and performs recording on the roll sheet R1 (R2) using a driving signal which is supplied from the head driving circuit 65.

The motor driving circuits 66 and 67 are respectively connected to the transport motor 71 and the feeding motor 72, and drive each motor (71, 72) using a command from the CPU 61. For this reason, each of the motor driving circuits 66 and 67 functions as a driver with respect to each of the motors 71 and 72.

The transport motor 71 is connected to a power transmission mechanism 73 which transmits power to a driving roller 15 of a pair of transport rollers. For this reason, the driving roller 15 rotates when the transport motor 71 is driven (rotated).

The feeding motor 72 is connected to a power transmission mechanism 76 which transmits power to the driving roller 22 (52) of the pair of feeding rollers. For this reason, the driving rollers 22 and 52 rotate when the feeding motor 72 is driven (rotated).

In addition, the I/OIF 69 is connected to an encoder 71*a* which is attached to the transport motor 71, an encoder 72*a* which is attached to the feeding motor 72, and the terminal end detection sensors 26 and 54.

The encoders 71*a* and 72*a* output the number of rotations of the transport motor 71, or the feeding motor 72 by converting the number of rotations into a pulse signal. The I/OIF 69 can receive outputs from the terminal end detection sensors 26 and 54, and the encoders 71*a* and 72*a*, respectively, and output the outputs to the CPU 61.

Figure 5:
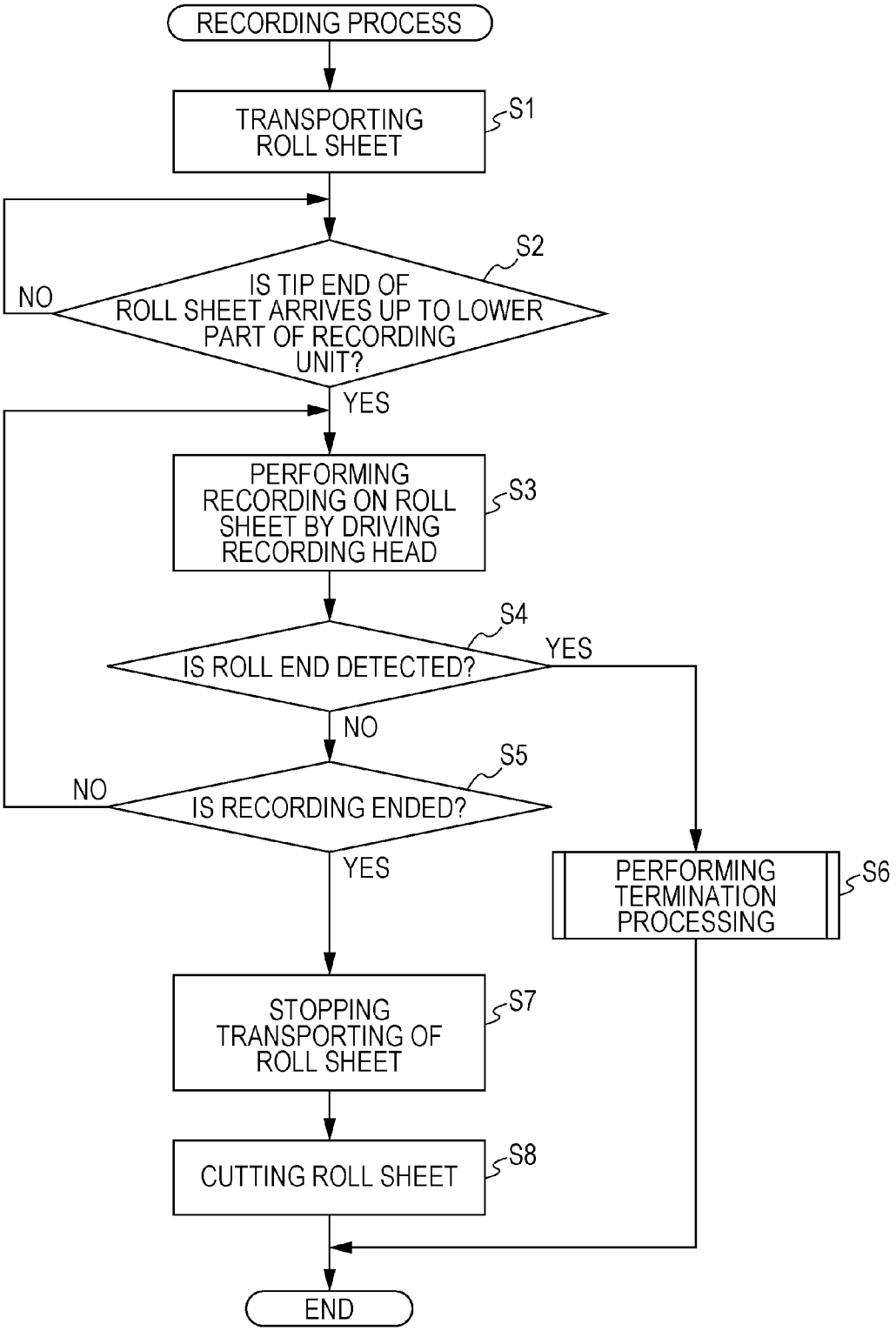
FIG. 5 is a flowchart which describes a flow of a recording process.
Figure 6:
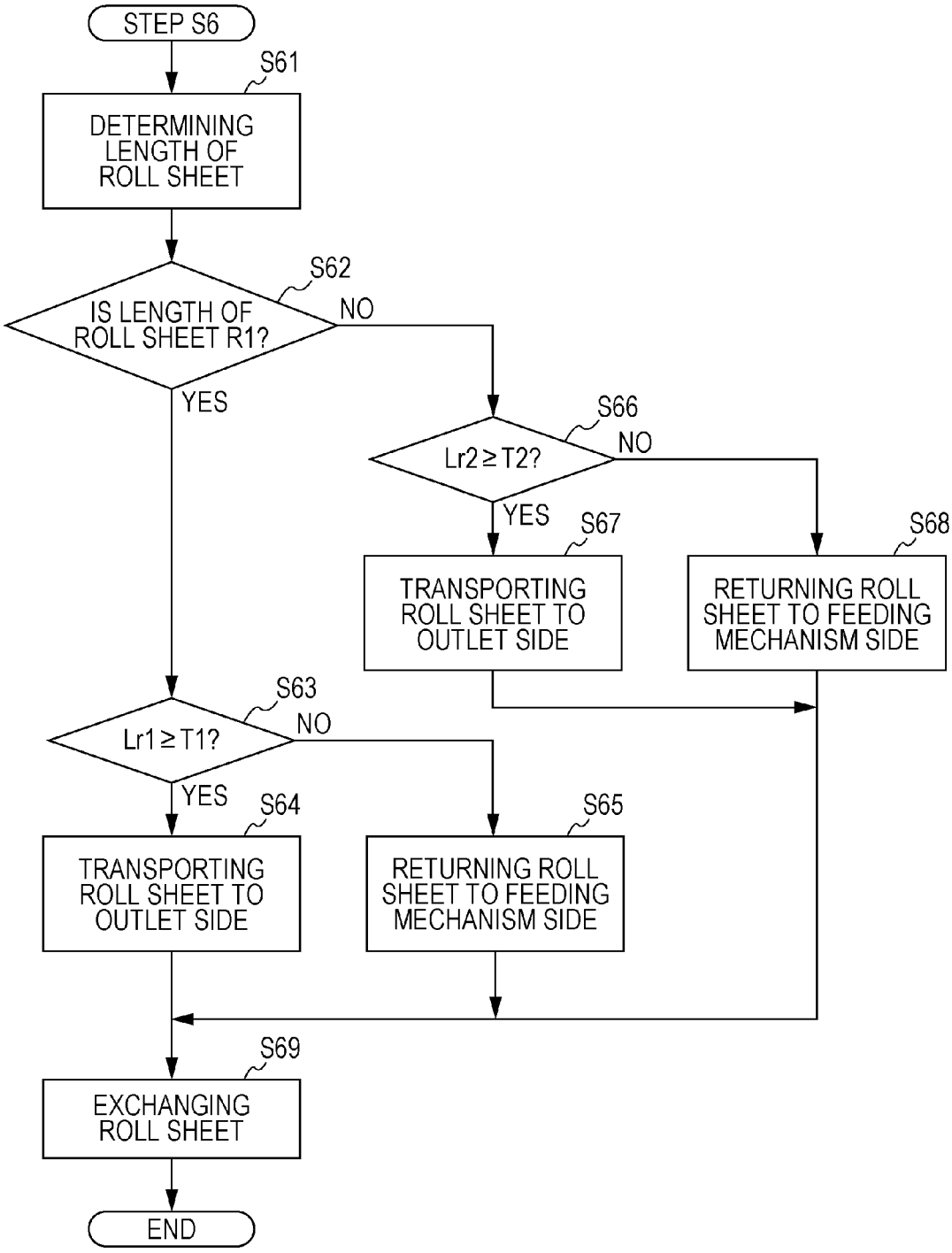
FIG. 6 is a flowchart which illustrates a process which is executed in step S6 in FIG. 5.

Subsequently, a recording process which is executed by the recording apparatus 1 will be described. FIG. 5 is a flowchart which describes a flow of the recording process. In addition, FIG. 6 is a flowchart which illustrates a process which is executed in step S6 in FIG. 5. In the following example, an example in which recording is performed with respect to the roll sheet R2 is mainly described, however, when it is necessary to describe a process relating to the roll sheet R1, the description will be made by illustrating an example in which recording is performed with respect to the roll sheet R1.

When a command for executing a recording process is output to the control unit 60 from a computer (not shown), or the like, the control unit 60 starts transporting of the roll sheet R2 in step S1. For this reason, the pair of feeding rollers 52 and 53 feed the roll sheet R2 to the pair of transport rollers 15 and 16 while pulling out the roll sheet R2 which is supported by the feeding mechanism 51. In addition, the pair of transport rollers 15 and 16 transports the fed roll sheet R2 toward the lower part of the recording head 13.

In addition, when a tip end of the roll sheet R2 arrives at the lower part of the recording head 13 by being transported by the pair of transport rollers 15 and 16 (Yes in step S2), a recording process by the recording head 13 is performed in step S3.

As a method of detecting arriving of the tip end of the roll sheet R2 at the pair of transport rollers 15 and 16 by the control unit 60, the control unit 60 may determine the arriving based on a signal from the encoder 71*a* which detects the number of rotations of the transport motor 71. For example, the number of rotations N of the transport motor 71 corresponding to an amount of transport of the roll sheet R2 (R1) is recorded in the ROM 62. In addition, the CPU 61 performs counting until the number of rotations of the transport motor 71 reaches N based on an output of a pulse signal from the encoder 71*a*.

In addition, a sensor for detecting the roll sheet R2 (R1) may be provided on the downstream side of the pair of transport rollers 15 and 16 on the transport path 11, in addition to this.

In addition, in the recording process, the pair of transport rollers 15 and 16 transport the tip end of the roll sheet R2 to the upper part of the platen 14 while interposing the roll sheet R2 therebetween. In addition, the control unit 60 reciprocates the recording head 13 in the main scanning direction based on the job data which is recorded in the non-volatile memory 64, and performs recording on the roll sheet R2 using ink.

In step S4, the control unit 60 determines whether or not the roll end of the roll sheet R2 is detected. Specifically, the control unit 60 determines whether or not the roll end is detected based on a change in a waveform of a signal which is output from the terminal end detection sensor 54.

In addition, when the roll end of the roll sheet R2 is not detected (No in step S4), the control unit 60 determines whether or not the recording process is ended in step S5. Specifically, when recording of the last raster data of a recording image which is included in the job data is not ended (No in step S5), the control unit 60 returns to step S3, and causes transporting of the roll sheet R2 using the pair of transport rollers 15 and 16, and recording on the roll sheet R2 using the recording head 13 to be continued.

In addition, when detecting that the control unit 60 ends the recording with respect to the roll sheet R2 (Yes in step S5) without detecting the roll end of the roll sheet R2 (No in step S4), the process proceeds to step S7. In step S7, the control unit 60 stops transporting of the roll sheet R2. In addition, in step S8, the control unit 60 cuts the roll sheet R2 by driving the cutter 18. For that reason, the cut tip end of the roll sheet R2 is discharged due to its own weight, and is accommodated in the stacker 19.

On the other hand, when the control unit 60 receives a signal of detecting the roll end of the roll sheet R2 from the terminal end detection sensor 54 (Yes in step S4), the process proceeds to step S6, and processes including a termination process are performed with respect to the roll sheet R2. As illustrated in FIGS. 1A and 1B, in the termination process, the transport direction of the roll sheet R2 (R1) is switched according to the length of the roll sheet R2 (R1) which remains in the path.

In the following example, the roll sheet R2 (R1) will be described as a roll sheet which is not adhered to a roll shaft, or does not have the roll shaft. As a matter of course, the roll sheet R2 (R1) may adhere to the roll shaft.

In step S61 in FIG. 6, the control unit 60 determines (obtains) the length of the roll sheet R2 which remains in the path. As an example, the control unit 60 determines the length of the roll sheet R2 according to a transport amount of the pair of transport rollers 15 and 16 (the number of rotations N1 and N2) until the roll end Re is detected after cutting the roll sheet R2 using the cutter 18 at the previous time. Here, the number of rotations N2 denotes the number of rotations of the pair of transport rollers 15 and 16 when transporting the roll sheet R2. In addition, the number of rotations N1 denotes the number of rotations of the pair of transport rollers 15 and 16 when transporting the roll sheet R1. Due to the process in step S61, the transport amount obtaining unit of the invention is realized.

Figure 7A:
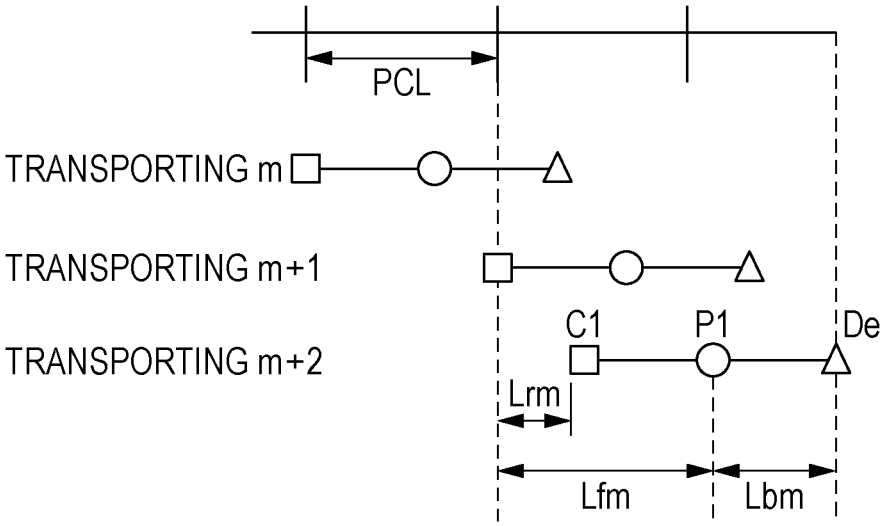
FIGS. 7A and 7B are diagrams which describe a configuration for switching a transporting direction of roll sheet.
Figure 7B:
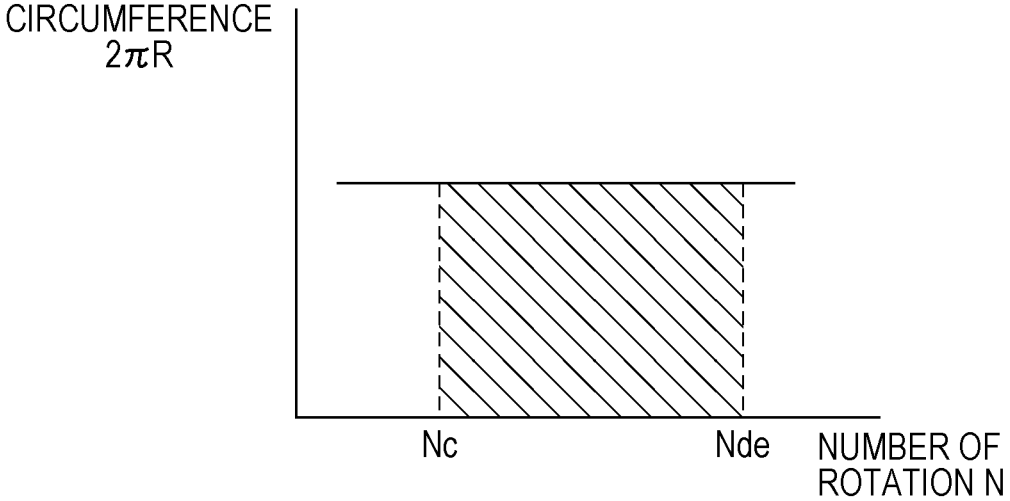

FIGS. 7A and 7B are diagrams which describe a configuration for switching the transport direction of the roll sheet. Here, FIG. 7A is a schematic diagram which illustrates a positional relationship among a position C1 of the cutter 18, a nipping position P1 of the pair of transport rollers 15 and 16, and a detection position De of the terminal end detection sensors 26 and 54. In addition, the length PCL denotes the cut length of the roll sheet R1 (R2). In addition, the length of the roll sheet R1 (R2) which is located on the downstream side from the nipping position P1 of the pair of transport rollers 15 and 16 is set to Lfm (hereinafter, referred to as tip end side length Lfm), and the length on the upstream side from the nipping position P2 is set to Lbm (hereinafter, referred to as distal end side length Lbm). In addition, m is an identifier which denotes any one of the roll sheets R1 and R2, and denotes any one value of 1 and 2.

As illustrated in FIG. 7A, since respective distances of the position C1 in the path, the nipping position P1, and the detection position De are fixed, transporting of the roll sheet R1 (R2) is performed while maintaining a positional relationship thereof. For that reason, the transport amount Lrm is transported in the m+2th transport of the pair of transport rollers 15 and 16. In addition, when the detection position De reaches the roll end Re of the roll sheet R2, the position C1 does not reach the cut length PCL, and the roll sheet R1 (R2) corresponding to the length Lpm from the tip end of the roll sheet R2 after being cut in the previous transport (m+1th) to the roll end Re of the roll sheet R2 remains on the path (that is, length in which tip end side length Lfm and distal end side length Lbm are added together).

In addition, FIG. 7B is a graph which illustrates a relationship between the number of rotations N and the transport amount, the horizontal axis denoting the number of rotations N, and the vertical axis denoting circumference 2ΠR of the pair of transport rollers 15 and 16. Since the pair of transport rollers 15 and 16 rotates at a constant speed ω, the transport amount Lrm of the roll sheet R2 (R1) until detecting the roll end after cutting at the previous time (m+1th) can be obtained as a value in which the circumference 2ΠR is multiplied by a difference between the number of rotations Nc at the time of performing the previous cut and the number of rotations Nde at the time of detecting the roll end Re (area denoted by slant line in FIG. 7B). For that reason, the tip end side length Lfm becomes the length in which a fixed value from the position C1 to the nipping position P1 is added to the transport amount Lrm of the roll sheet R2 (R1).

When the transported roll sheet is R2 in step S62 in FIG. 6 (No in step S62), the control unit 60 proceeds to step S66. In addition, in step S66, the control unit 60 compares the length of the roll sheet R2 which is determined in step S61 to a threshold value T2. In the first embodiment, the threshold value T2 is a value corresponding to the length of the roll sheet R2. More specifically, the value is a value corresponding to the transport amount Lrm of the pair of transport rollers 15 and 16. In addition, a threshold value T1 which will be described later is a value corresponding to the length of the roll sheet R1.

As illustrated in FIG. 1A, when the length Lp2 of the roll sheet R2 after detecting the roll end is equal to or greater than the length RL of the path from the nipping position P1 to the outlet 17, it is possible to make the tip end of the roll sheet R2 be exposed from the outlet 17 due to transporting of the pair of transport rollers 15 and 16. For that reason, a user can take the roll sheet R2 out from the outlet 17. As a matter of course, when the length of the roll sheet R2 which comes out from the outlet 17 becomes longer, the roll sheet R2 falls due to its own weight, and is accommodated in the stacker 19.

On the other hand, as illustrated in FIG. 1B, when the length Lp2 of the roll sheet R2 after detecting the roll end is equal to or smaller than the length RL, the tip end of the roll sheet R2 is not exposed from the outlet 17 even when the roll sheet R2 is transported using the pair of transport rollers 15 and 16. For that reason, a user cannot take the roll sheet R2 out from the outlet 17.

For that reason, according to the first embodiment, the threshold value T2 is set to a value corresponding to the transport amount Lr2 which is a variation component of the length of the roll sheet R2. As a matter of course, setting the threshold value T2 (T1) to the transport amount Lrm is merely an example, and the value may be a value based on the length of the roll sheet R2 (R1).

In addition, when determining each threshold value T2 (T1) using the transport amount Lrm, a different value is set according to the length of the transport path. As illustrated in FIG. 7A, the length Lpm of the roll sheet R1 (R2) is a sum of the tip end side length Lfm and the distal end side length Lbm, and in the same length Lpm, when the distal end side length Lbm is long, the tip end side length Lfm becomes short. In addition, since the length Lbm is a fixed value from the terminal end detection sensor 26 (54) to the nipping position P1, the value becomes a value corresponding to the path length of the first feeding path 20 and the second feeding path 30.

According to the first embodiment, the path length of the second feeding path 30 is longer than the path length of the first feeding path 20, and the distal end side length Lpb2 of the roll sheet R2 is longer than the distal end side length Lpb1 of the roll sheet R1. As a result, a transport amount Lr2 (threshold value T2) which is a variation component of the tip end side length Lpf2 of the roll sheet R2 can at least expose the tip end of the roll sheet R2 from the outlet 17 due to transporting, compared to a transport amount Lr1 (threshold value T1) which is a variation component of the tip end side length Lpf1 of the roll sheet R1.

When a transport amount Lr2 of the roll sheet R2 which is determined in step S61 is equal to or greater than the threshold value T2 (Yes in step S66), the control unit 60 causes the pair of transport rollers 15 and 16 to rotate, and transports the roll sheet R1 to the outlet 17 in step S67. At this time, the recording head 13 may perform recording with respect to the roll sheet R2.

In addition, when the transport amount Lr2 of the roll sheet R2 is less than the threshold value T2 (No in step S66), the control unit 60 causes the pair of transport rollers 15 and 16 to rotate in the opposite direction, and returns the roll sheet R1 to the feeding mechanism 51 side in step S68. For that reason, the recording head 13 does not perform recording with respect to the roll sheet R2, and the roll sheet R2 is transmitted to the feeding mechanism 51 side.

For that reason, the roll end Re of the roll sheet R2 is pushed to the feeding unit 50 side through the insertion opening 41. As described above, the second feeding path 30 is shielded by the shielding unit 40 for safety, and it is not possible to put a hand inside from the feeding unit 50 side. For that reason, when the distal end side of the roll sheet R2 is pushed to the feeding unit 50 side through the insertion opening 41, a user can take the roll sheet R2 out when exchanging the roll sheet R2. For that reason, even when the transport path is shielded, it is possible to take the roll sheet out through the insertion opening 41, and to reduce a work load when exchanging the roll sheet (R1 and R2).

At this time, since the roll sheet R2 is transported to the feeding unit 50 side without cutting the roll sheet R2 when the roll end of the roll sheet R2 is detected, it is possible to reliably remove the roll sheet R2 without a remaining cut end of the roll sheet R2 being in the path.

In addition, when the transported roll sheet is R1 (Yes in step S62), and in step S63, when the transport amount Lr1 of the roll sheet R1 which is determined in step S61 is equal to or greater than the threshold value T1 (Yes in step S63), the control unit 60 transmits the roll sheet R1 to the outlet 17 side by rotating the pair of transport rollers 15 and 16 in step S64.

On the other hand, when the length of the roll sheet R1 which is determined in step S61 is less than the threshold value T1 (No in step S63), the control unit 60 returns the roll sheet R1 to the feeding mechanism 21 side by rotating the pair of transport rollers 15 and 16 in the opposite direction in step S65.

In addition, in step S69, the control unit 60 exchanges the roll sheet. When the recording apparatus 1 uses the roll sheet R2, the control unit 60 stops transporting of the roll sheet R2 of which the roll end is detected. In addition, the roll sheet R1 is supplied to the pair of transport rollers 15 and 16 by driving the pair of feeding rollers 22 and 23. As a result, recording on the roll sheet R1 is started. For that reason, it is possible for the recording apparatus 1 to use a plurality of roll sheets (R1 and R2), and to execute a large amount of jobs. In addition, when a roll end of a supported roll sheet (R1 and R2) is detected, since it is possible to switch to the subsequent roll sheet and use the sheet, it is possible for a worker to continue recording without taking the roll sheet out.

As described above, according to the first embodiment, in a case of exchanging a roll sheet which is used up to a roll end, when the length of the roll sheet which remains in the path is long, the roll sheet is discharged as is from the outlet.

In addition, when the length of a roll sheet which remains in the path is long, it is possible to perform printing to the vicinity of a terminal end of the roll sheet by discharging the roll sheet to the outlet side, and to reduce waste of a roll sheet.

On the other hand, when the length of a roll sheet which remains in the path is short, it is possible to allow the roll sheet to be easily taken out by transporting the sheet to the medium support unit side. As a result, it is possible to reduce a work load when exchanging the roll sheet.

In addition, since the threshold value can be set according to the path length, it is possible to flexibly design an arrangement position of the feeding mechanism.

2. Second Embodiment

The recording apparatus 1 may be an apparatus which uses only one roll sheet, in addition to an apparatus in which using of roll sheets R1 and R2 can be switched between, as in the first embodiment.

3. Other Embodiments

In addition, various modification examples can be taken into consideration in the invention.

For example, a medium for recording which can be applied to the invention may be a folded continuous sheet, in addition to a roll sheet.

In addition, the recording apparatus 1 uses the cutter 18 as an example, and the cutter 18 may not be used.

In addition, a configuration in which each configuration disclosed in the above described embodiment and the modification example is mutually substituted, or a combination is changed, a configuration in which each configuration disclosed in a well-known technology, the above described embodiment and the modification example is mutually substituted, or a combination is changed, or the like, also can be executed. The invention also includes these configurations.

The entire disclosure of Japanese Patent Application No. 2013-071610, filed Mar. 29, 2013 is expressly incorporated by reference herein.

What is claimed is:

1. A recording apparatus in which a recording unit performs recording with respect to a medium for recording which is wound in a roll shape, the apparatus comprising:

a medium support unit which rotatably supports the medium for recording;

a transport unit which transports the medium for recording while pulling out the medium for recording which is supported;

a terminal end detection unit which detects a terminal end of the medium for recording;

a first medium support unit; and a second medium support unit, wherein the transport unit transports the medium for recording to an outlet side to which the medium for recording, which is recorded, is discharged, when the terminal end is detected, and a length of the medium for recording is equal to or larger than a predetermined value, wherein the transport unit transports the medium for recording to the medium support unit side, when the terminal end is detected, and the length of the medium for recording is less than the predetermined value, wherein the transport unit transports either a medium for recording which is supported by the first medium support unit, or a medium for recording which is supported by the second medium support unit, and wherein, when detecting the terminal end of the medium for recording which is supported by the first medium support unit, the transport unit switches to transport of the medium for recording which is supported by the second medium support unit.

2. The recording apparatus according to claim 1, wherein a shielding unit which shields a path on which the medium for recording is transported is located between the medium support unit and the transport unit on the path of the medium for recording, and wherein the medium for recording is transported to the transport unit while passing through an opening which is formed in the shielding unit.

3. The recording apparatus according to claim 1, further comprising:

a cutting unit which is located on a downstream side of the medium support unit on the path of the medium for recording, and cuts the medium for recording, wherein the cutting unit cuts the medium for recording when the terminal end is not detected, and wherein the cutting unit does not cut the medium for recording when the terminal end is detected.

4. The recording apparatus according to claim 1, further comprising:

a transport amount obtaining unit which obtains a transport amount of the medium for recording, wherein the length of the medium for recording is determined based on a transport amount of the transport unit from discharging of a portion of the medium for recording on which the recording is performed to detecting of the terminal end.

5. The recording apparatus according to claim 1, wherein the predetermined value is set according to a length of the path on which the medium for recording which is supported by the medium support unit is transported.

6. A transporting apparatus which transports a medium to be transported which is wound in a roll shape comprising:

a medium support unit which rotatably supports the medium to be transported;

a transport unit which transports the medium to be transported while pulling out the medium to be transported which is supported;

a terminal end detection unit which detects a terminal end of the medium to be transported;

a first medium support unit; and a second medium support unit, wherein the transport unit transports the medium to be transported to an outlet side, when the terminal end is detected, and a length of the medium to be transported is equal to or larger than a predetermined value, wherein the transport unit transports the medium to be transported to the medium support unit side, when the terminal end is detected, and the length of the medium to be transported is less than the predetermined value, wherein the transport unit transports either a medium for recording which is supported by the first medium support unit, or a medium for recording which is supported by the second medium support unit, and wherein, when detecting the terminal end of the medium for recording which is supported by the first medium support unit, the transport unit switches to transport of the medium for recording which is supported by the second medium support unit.

* * * * *